United States Patent [19]

Noda et al.

[11] Patent Number: 5,057,736

[45] Date of Patent: Oct. 15, 1991

[54] DIRECTLY-HEATED CATHODE STRUCTURE

[75] Inventors: Makoto Noda; Hiroaki Takenaka, both of Shiga, Japan

[73] Assignee: NEC Corporation, Japan

[21] Appl. No.: 499,700

[22] Filed: Mar. 27, 1990

[30] Foreign Application Priority Data

Apr. 7, 1989 [JP] Japan ..... 1-41446[U]

[51] Int. Cl.[5] ..... H01J 19/08; H01J 1/15

[52] U.S. Cl. ..... 313/345; 313/345; 313/346

[58] Field of Search ..... 313/345, 344, 346 R, 313/629

[56] References Cited

U.S. PATENT DOCUMENTS 1,616,044 2/1927 Harrington ..... 313/629
4,031,426 6/1977 Kern ..... 313/346 R

FOREIGN PATENT DOCUMENTS 55-37717 3/1980 Japan .
57-36750 2/1982 Japan .
57-87041 5/1982 Japan .

*Primary Examiner*—Palmer C. DeMeo
*Attorney, Agent, or Firm*—Leydig, Voit & Mayer

[57] ABSTRACT

A directly-heated cathode structure for use in a compact cathode ray tube comprises an insulating support body, a pair of cathode lead pins fixedly carried in the insulating support body, and a filament extending between the leading ends of said cathode lead pins. An electron emitting material is applied to and coated on the filament over its entire length including its two ends joining with the leading ends of the cathode lead pins so that the electron emitting material once hardened ensures that the two ends of the filament are firmly fixed to the leading ends of the cathode lead pins. The insulating support body may have a groove which is formed across the upper face thereof and within which the leading ends of the cathode lead pins are exposed in a spaced relation, which helps confining undesirable scattering of the electron emitting material when sprayed to the filament.

8 Claims, 3 Drawing Sheets

DIRECTLY-HEATED CATHODE STRUCTURE

BACKGROUND OF THE INVENTION

The present invention relates to a directly-heated cathode structure and, more particularly, to a directly-heated cathode structure for use in a compact cathode ray tube which is utilized, for example, in the viewfinder of a video camera.

In a conventional directly-heated cathode structure for a compact cathode ray tube which includes a pair of cathode lead pins, a pair of control (grid) electrode lead pins, a filament and an electron emitting material, the filament extends between the two cathode lead pins and is welded at each of the ends thereof to each of the leading ends of the cathode lead pins and the electron emitting material such as a metal carbonate ($CaCO_3$, $BaCO_3$, $SrCO_3$) is applied to the filament at its approximate center portion.

A problem experienced in a conventional directly-heated cathode structure as explained above is that, since each end of the filament is welded while being pressed to each top end of the cathode lead pins, the former and the latter are not necessarily uniformly and evenly joined together. This is resulted from variations in the ways in which the ends of the filament are welded to the ends of the cathode lead pins. When a voltage is applied between the two cathode lead pins and the filament is heated for the emission of electrons from the electron emitting material, any defective weld or incomplete join in the respective ends may cause the filament to vibrate or render the filament to be easily affected by externally caused vibrations resulting in such problems as appearance of noise on the screen of the cathode ray tube due to instability in the emission of electrons.

Another problem in a conventional directly-heated cathode structure is that, when the electron emitting material is applied to the filament by a spray means, the electron emitting material scatters around so that the leading ends of the control electrode lead pins tend to catch the scattered electron emitting material, which makes it difficult to achieve a good welding of the control electrode to the leading ends of the control electrode lead pins.

The disclosure of a directly-heated cathode structure of the type explained above or at least a type similar thereto is found in, for example, Japanese Patent Application Kokai No. Sho 55-37,717 (1980), Hitachi Seisakusho K. K. as applicant; Japanese Patent Application Kokai No. Sho 57-36,750 (1982), Sony K. K. as applicant; and Japanese Patent Application Kokai No. Sho 57-87,041 (1982)-Kokoku No. Sho 63-53,661 (1988), Sony K. K. as applicant. It is to be noted, however, that none of these publications describes or illustrates the electron emitting material being applied to the entire length of the filament including its two end portions joining with the leading ends of the cathode lead pins, which is one of the features of the present invention.

SUMMARY OF THE INVENTION

It is an object of the present invention to provide an improved directly-heated cathode structure for use in a compact cathode ray tube which overcomes the above explained problems in the prior art.

According to the present invention, there is provided a directly-heated cathode structure comprising an insulating support body, a pair of cathode lead pins fixedly supported in the insulating support body, a filament extending between the leading ends of the cathode lead pins, and an electron emitting material applied to the filament over its entire length including its two end portions joining with the leading ends of the cathode lead pins. Because the electron emitting material is coated on the filament not only over its intermediate portion but also its two end portions, the electron emitting material once hardened ensures that the two ends of the filament are firmly fixed to the leading ends of the cathode lead pins.

Also, another feature of the present invention resides in the configuration wherein the insulating support body has a groove formed across the upper face of the support body and the cathode lead pins have their leading ends exposed within the groove. This configuration helps confining undesirable scattering of the electron emitting material when sprayed to the filament.

BRIEF DESCRIPTION OF THE DRAWINGS

The above and other objects and advantages of the present invention will be apparent from the following description of preferred embodiments of the invention with reference to the accompanying drawings, in which.

PREFERRED EMBODIMENTS OF THE INVENTION

Throughout the following description, similar reference symbols or numerals refer to like or similar elements in all Figures of the drawings.

For the purpose of assisting in the understanding of the present invention, a conventional directly-heated cathode structure will first be described briefly by making reference to FIGS. 5 through 7 before the explanation of the present invention.

Figure 5:
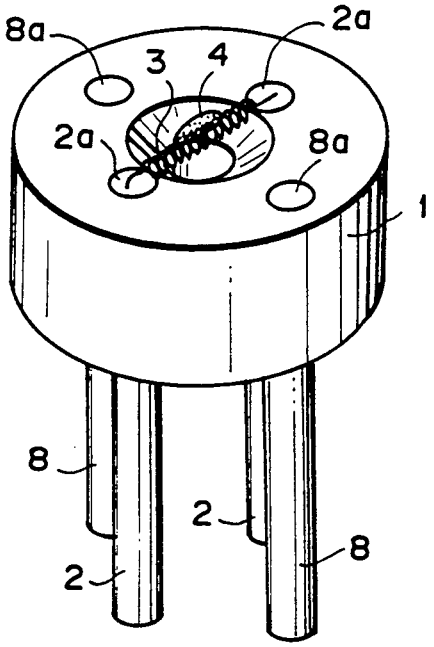
FIG.5 PRIOR ART
FIG. 5 shows a perspective view of a typical conventional directly-heated cathode structure.
Figure 6:
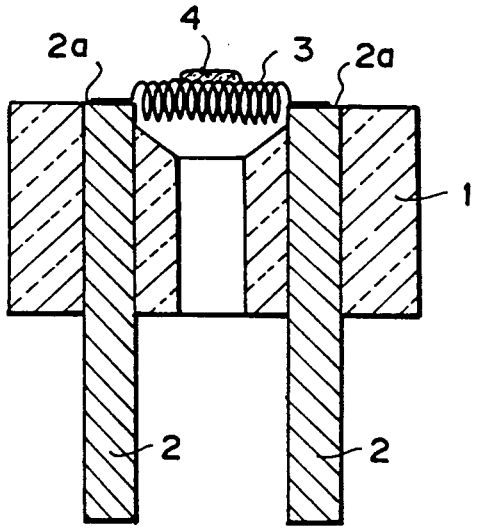
FIG.6 PRIOR ART
FIG. 6 shows a sectional view of the conventional directly-heated cathode structure shown in FIG. 5.

FIGS. 5 and 6 show an example of the typical conventional directly-heated cathode structure. In this configuration, an insulating support body 1 which has a good dielectric strength supports therein a pair of cathode lead pins 2, 2 and also a pair of control electrode pins 8, 8 and each of the ends of a filament 3 is partly buried in and welded to each of the corresponding leading ends *2a*, *2a* of the cathode lead pins 2, 2. The filament 3 extends over between the two leading ends *2a*, *2a* of the cathode lead pins 2, 2 and an electron emitting material such as a metal carbonate is applied to and carried by the filament 3 at its approximate center portion.

Figure 7:
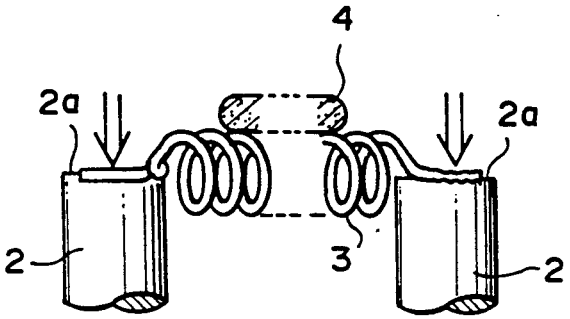
FIG.7 PRIOR ART
FIG. 7 shows an enlarged view of the main elements of the conventional directly-heated cathode structure as shown in FIG. 5.

In the conventional directly-heated cathode structure as explained above, each of the ends of the filament 3 is, as clearly shown in FIG. 7, partly buried in and welded to each of the leading ends 2a, 2a of the cathode lead pins 2, 2. The welding is typically carried out while pressure is applied to the respective ends. However, the ends of the filament 3 and the leading ends 2a, 2a of the cathode lead pins 2, 2 often fail to make the desired match joint because of unavoidable changes in the degree of the defacing of the ends of the filament 3 or in the degree of the burying-in of the end of the filament 3. This tends to result in variations in the welding between the ends of the filament 3 and the ends of the cathode lead pins 2, 2. When a voltage is applied between the two cathode lead pins 2, 2 and the filament 3 is heated for the emission of electrons from the electron emitting material 4, any defective welding or incomplete joining of the respective ends may cause the filament 3 to vibrate or may render the filament 3 to be easily vibrated by external causes. This does and can cause such problems as appearance of noise on the screen of the cathode ray tube due to instability in the emission of electrons from the electron emitting material 4.

Another problem experienced in such a conventional directly-heated cathode structure is that, in the course of having the electron emitting material 4 sprayed to the filament 3, the electron emitting material 4 scatters around and the leading ends 8a, 8a of the control electrode lead pins 8, 8 may catch the undesirable scattered electron emitting material. When this takes place, it becomes difficult to achieve a good welding of the control electrode to the leading ends 8a, 8a of the control electrode lead pins 8, 8.

Thus, the present invention aims at providing an improved directly-heated cathode structure which overcomes the problems as explained above.

Hereinafter, some preferred embodiments of the present invention are explained with reference to FIG. 1 to FIG. 4.

Figure 1:
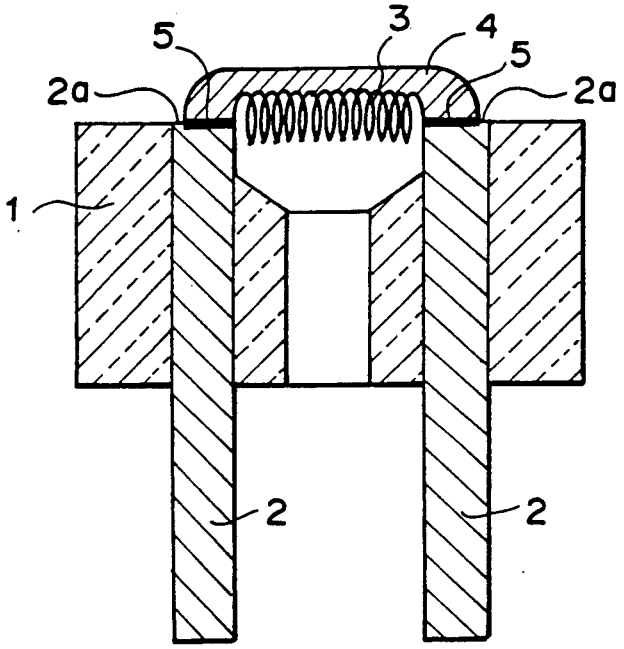
FIG. 1 shows a sectional view of a directly-heated cathode structure of a first embodiment according to the present invention.
Figure 2:
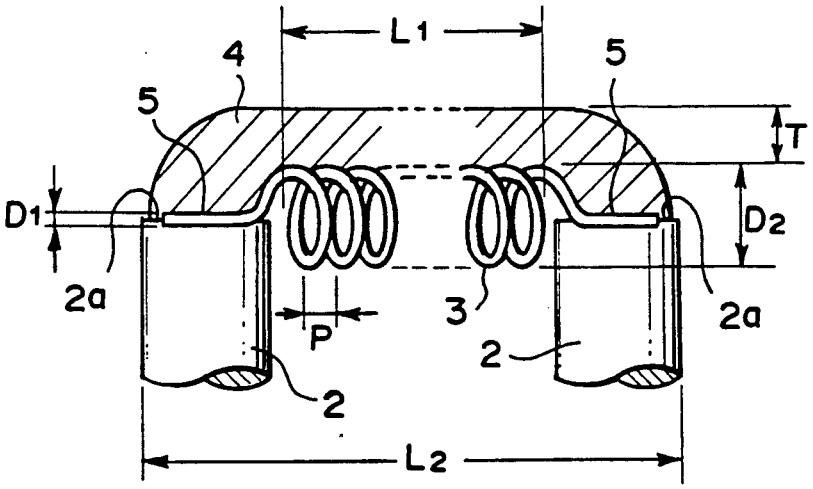
FIG. 2 shows an enlarged view of the main elements of the directly-heated cathode structure as shown in FIG. 1.

FIG. 1 shows a sectional view of a directly-heated cathode structure of a first embodiment according to the present invention and FIG. 2 shows an enlarged view of the main elements of the directly-heated cathode structure as shown in FIG. 1.

The directly-heated cathode structure as shown in FIG. 1 and FIG. 2 is a kind which is adapted to be housed within a compact cathode ray tube such as in the view-finder of a video camera. An insulating support body 1 which has a high dielectric strength and which may be of a ceramic material carries a pair of cathode lead pins 2, 2 provided therein in a spaced relation. Each end of a filament 3 of a tungsten wire wound into a coil is welded to each of leading ends 2a, 2a of the cathode lead pins 2, 2 and thus the filament 3 extends over between the leading ends 2a, 2a. The welding process is carried out while the pressure is being applied on the ends of the filament 3 against the leading ends 2a, 2a of the cathode lead pins 2, 2. The electron emitting material 4 such as a metal carbonate is sprayed to and carried by the filament 3 through its entire length including the filament end portions joining with the leading ends 2a, 2a. The metal carbonate here is, for example, a calcium carbonate $CaCO_3$, a barium carbonate $BaCO_3$, or a strontium carbonate $SrCO_3$. The distinguishing feature here over the conventional directly-heated cathode structure as explained above is that the sprayed electron emitting material covers not only the intermediate and center portion of the filament 3 but also the entire filament 3 including its ends overlaying on the leading ends 2a, 2a.

Figure 3:
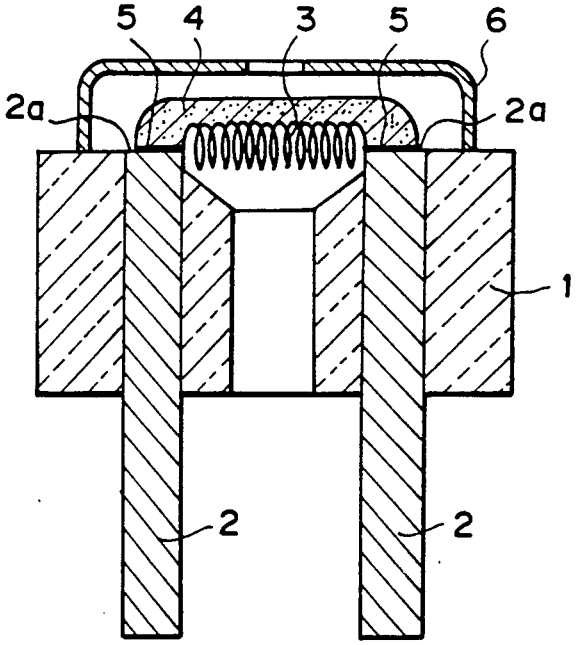
FIG. 3 shows a sectional view of the directly-heated cathode structure, as shown in FIG. 1, in the state in which a control electrode is included.
Figure 4:
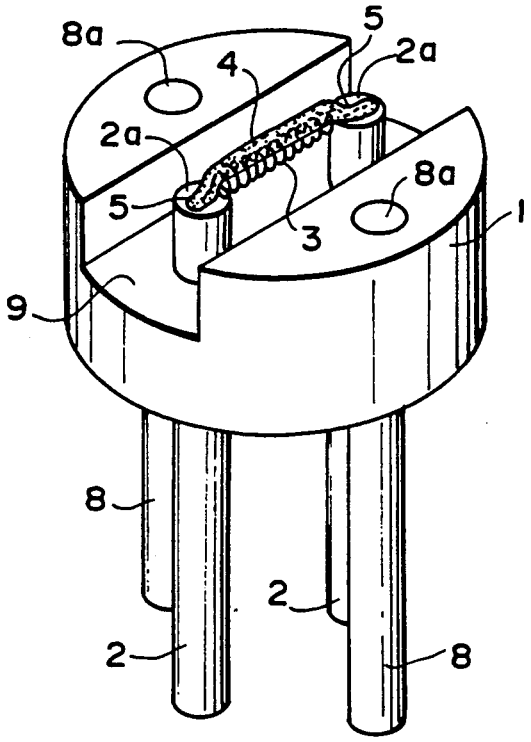
FIG. 4 shows a perspective view of a directly-heated cathode structure of a second embodiment according to the present invention.

Although FIG. 1 and FIG. 3 do not show them, the insulating support body 1 also carries a pair of control electrode lead pins 8, 8 as shown in FIG. 4.

Now, detailed dimensions of some of the main elements of the directly-heated cathode structure may be given, by way of example, as follows: If the specification of the cathode is for 0.6 V and 20 mA, preferably the diameter $D_1$ of the filament 3 may be 0.012 mm, the diameter $D_2$ of the coil may be 0.15 mm, the coil pitch P may be 0.032 mm, the effective length $L_1$ of the coil portion within the length between the two leading ends 2a, 2a of the lead pins 2, 2 may be 1.2 mm, the entire length $L_2$ of the filament including the joining ends may be 2.0 mm, and the coating thickness T of the electron emitting material 4 may be 0.04 mm. If the specification of the cathode is for 0.6 V and 10 mA, preferably the diameter $D_1$ of the filament 3 may be 0.008 mm, the diameter $D_2$ of the coil may be 0.075 mm, the coil pitch P may be 0.016 mm, the effective length $L_1$ of the coil portion between the two leading ends 2a, 2a may be 1.2 mm, the entire length $L_2$ of the filament including the joining ends may be 2.0 mm, and the coating thickness T of the electron emitting material 4 may be 0.03 mm. Further, for 0.5 V and 10 mA type cathode, the most favorable coating thickness of the emitting material is 0.01 mm.

As to the coating thickness T of the electron emitting material on the filament 3, if it is too thick, the thermal transfer from the filament 3 to the electron emitting material 4 is adversely affected and the amount of the electron emitting material 4 used is uneconomical. On the other hand, if the thickness T is too thin, the effect of vibration proof of the filament 3 becomes insufficient. Thus, the coating thickness T is preferably in the range from 0.01 mm to 0.04 mm as given above.

As shown in FIG. 3, the insulating support body 1 carries at its upper surface a control electrode 6 both ends of which are welded to the top ends of control electrode lead pins (not shown). The directly-heated cathode structure having such a configuration is installed in the neck portion of a compact cathode ray tube.

In the present directly-heated cathode structure, the electron emitting material 4 is applied to the filament 3 over its entire length, including its two ends 5, 5 joined to the leading ends 2a, 2a of the cathode lead pins 2, 2. Consequently the electron emitting material 4, once hardened, ensures that the two ends 5, 5 of the filament 3 are firmly fixed to the two leading ends 2a, 2a of the cathode lead pins 2, 2. Thus, there is no vibration of the filament 3 which may otherwise be caused by incomplete joining of the respective ends and which may take place when a voltage is applied between the two cathode lead pins 2, 2 and the filament 3 is heated for the emission of electrons from the electron emitting material 4. Firm fixing of the filament 3 to the leading ends 2a, 2a also prevents vibration of the filament 3 against any mechanical movement externally applied. When a voltage is applied thereby heating the filament 3 and the electron emitting material 4, the electrons are emitted stably from the electron emitting material 4 and this helps preventing appearance of noise on the screen of the cathode ray tube.

FIG. 4 shows a perspective view of a directly-heated cathode structure of a second embodiment according to the present invention. The arrangement includes an insulating support body 1 having a groove 9 formed across the upper face of the support body, a pair of cathode lead pins 2, 2 having leading ends 2*a*, 2*a* exposed within the groove 9 and fixedly held by the insulating support body 1, a filament 3 extending over between the leading ends 2*a*, 2*a* of the cathode lead pins 2, 2, and an electron emitting material 4 applied to the filament 3 over its entire length including its two ends 5, 5 joining with the leading ends 2*a*, 2*a* of the cathode lead pins 2, 2. As in the first embodiment, the electron emitting material 4 extends and covers the entire length of the filament 3 including the respective joining ends. The insulating support body 1 also carries therein control electrode lead pins 8, 8 as shown in the drawing.

In the directly-heated cathode structure of this second embodiment, one of the important features is that the insulating support body 1 has the groove 9 formed across the upper face of the support body. In the course of having the electron emitting material 4 sprayed to the filament 3, any scattered electron emitting material 4 flows through the groove 9 and out to the sides thereof so that the ends 8*a*, 8*a* of the control electrode lead pins 8, 8 hardly catches the scattered electron emitting material. This facilitates achieving a good and secured welding of the control electrode to the leading ends 8*a*, 8*a* of the control electrode lead pins 8, 8.

As to the advantages enjoyed by the feature that the filament 3 extends and covers the entire length of the filament 3, the same explanation as made with respect to the first embodiment applies to this second embodiment.

While the invention has been described in its preferred embodiments, it is to be understood that the words which have been used are words of description rather than limitation and that changes within the purview of the appended claims may be made without departing from the true scope and spirit of the invention its broader aspects.

What is claimed is:

1. A directly-heated cathode structure comprising:

an insulating support body:

a pair of cathode lead pins fixedly carried in said insulating support body, each pin having a leading end;

a filament extending between the leading ends of said cathode lead pins and having two ends joined to the leading ends of the cathode lead pins; and an electron emitting material coated on said filament over its entire length including its two ends.

2. A directly-heated cathode structure according to claim 1, in which the coating thickness of said electron emitting material applied to said filament is in the range between 0.01 mm and 0.04 mm.

3. A directly-heated cathode structure according to claim 1, wherein the filament includes a coil portion and wherein the entire length of the filament and the length of the coil portion of the filament are 2.0 mm and 1.2 mm, respectively.

4. A directly-heated cathode structure comprising:

an insulating support body having a groove formed across the upper face of the support body;

a pair of cathode lead pins having leading ends exposed within said groove and fixedly carried in said insulating support body;

a filament extending between the leading ends of said cathode lead pins and having two ends joined to the leading ends of the cathode lead pins; and an electron emitting material coated on said filament over its entire length including its two ends.

5. A directly-heated cathode structure according to claim 4, in which the coating thickness of said electron emitting material applied to said filament is in the range between 0.01 mm and 0.04 mm.

6. A directly-heated cathode structure comprising:

an insulating support body having an upper surface;

a pair of cathode lead pins fixedly carried in said insulating support body, each pin having a leading end which is even with the upper surface of the support body;

a filament extending between the leading ends of said cathode lead pins and having two ends joined to the leading ends of the cathode lead pins; and an electron emitting material coated on said filament over its entire length including its two ends.

7. A directly-heated cathode structure according to claim 6 further comprising a pair of control electrode lead pins carried by the insulating support body and a control electrode which extends between the control electrode lead pins over the upper surface of the insulating support body.

8. A directly-heated cathode structure according to claim 7, in which the coating thickness of said electron emitting material applied to said filament is in the range between 0.01 mm and 0.04 mm, in which the filament includes a coil, the effective length of the coil being 1.2 mm and the entire length of the filament being 2.0 mm.

* * * * *